US006640706B1

(12) United States Patent
Gieser et al.

(10) Patent No.: US 6,640,706 B1
(45) Date of Patent: Nov. 4, 2003

(54) GUIDING DEVICE FOR AN AREAL PRINTING MATERIAL

(75) Inventors: Michael Gieser, Oftersheim (DE); Peter Thoma, Mannheim (DE); Jörg Oliver Kain, Weiterstadt (DE); Mathias Schuster, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/699,981

(22) Filed: Oct. 30, 2000

(30) Foreign Application Priority Data

Oct. 28, 1999 (DE) ..... 199 51 894

(51) Int. Cl.[7] ..... B41F 13/24; B41F 1/30; B65H 29/32

(52) U.S. Cl. ..... 101/232; 101/233; 101/410; 101/483; 271/197

(58) Field of Search ..... 101/232, 483, 101/233, 416, 424; 271/195

(56) References Cited

U.S. PATENT DOCUMENTS 5,243,909 A * 9/1993 DeMoore et al. ..... 101/420
5,320,042 A * 6/1994 Schwopfinger ..... 101/416.1
5,497,987 A * 3/1996 Henn et al. ..... 271/204
5,655,449 A * 8/1997 Henn et al. ..... 101/232
5,718,176 A * 2/1998 Stephan ..... 101/483
5,797,827 A 8/1998 Sondergeld
5,816,155 A * 10/1998 Stephan ..... 101/232
5,927,203 A * 7/1999 Gieser et al. ..... 101/419
5,992,845 A 11/1999 Fendler et al.
6,182,567 B1 * 2/2001 Gunschera et al. ..... 101/232
6,378,425 B1 * 4/2002 Stephan ..... 101/232

FOREIGN PATENT DOCUMENTS

| | | |
|---|---|---|
| DE | 43 38 947 C2 | 5/1995 |
| DE | 195 21 442 A1 | 5/1996 |
| DE | 195 15 393 A1 | 10/1996 |
| DE | 196 02 514 C1 | 4/1997 |
| DE | 198 10 387 C1 | 7/1999 |

* cited by examiner

*Primary Examiner*—Andrew H. Hirshfeld
*Assistant Examiner*—Marvin P. Crenshaw
(74) *Attorney, Agent, or Firm*—Lawrence A. Greenberg; Werner H. Stemer; Ralph E. Locher

(57) ABSTRACT

A guiding device for an areal printing material, the guiding device having an areal structure with a guide surface facing towards the printing material, and wherein the areal structure includes a supporting layer, and a surface layer is provided for forming the guide surface and covering the supporting layer; and a rotary printing machine equipped with the guiding device.

10 Claims, 4 Drawing Sheets

GUIDING DEVICE FOR AN AREAL PRINTING MATERIAL

BACKGROUND OF THE INVENTION

FIELD OF THE INVENTION

The invention relates to a guiding device for an areal printing material with a substantially two-dimensional structure, such as a sheet material, the guiding device having a guide surface facing the printing material. The invention further relates to a sheet-processing machine, in particular a rotary printing machine, equipped with such a guiding device.

A guiding device of the aforementioned type is disclosed, for example, by the published German Patent Document DE 196 02 514 C1. As this document discloses, high requirements are placed on guiding devices for sheet printing materials, and in fact, particularly on the guide surface formed thereon. They must be made especially smooth. Guiding devices used by the applicant therefore have a high-gloss polished guide surface. This requires particularly careful procedures in the production and handling of a conventional guiding device and, therefore, involves the risk of a given rate of wastage.

SUMMARY OF THE INVENTION

It is accordingly an object of the invention to provide a guiding device of the type mentioned in the introduction hereto, which can be produced with a possible wastage or reject rate that is considerably reduced.

With the foregoing and other objects in view, there is provided, in accordance with one aspect of the invention, a guiding device for an areal printing material, the guiding device having an areal structure with a guide surface facing towards the printing material, the areal structure comprising a supporting layer, and a surface layer is included for forming the guide surface and covering the supporting layer.

In accordance with another feature of the invention, the guiding device includes at least one support which, together with the supporting layer, forms a subassembly.

In accordance with a further feature of the invention, the support is trough-like in structure, has feed and discharge openings, and is otherwise closed by the supporting layer.

In accordance with an added feature of the invention, the support and the supporting layer are sealingly joined to one another.

In accordance with an additional feature of the invention, the support has a trough base formed with elevations, and the elevations are joined to the supporting layer.

In accordance with yet another feature of the invention, the support and a respective one of the elevations, on the one hand, and the supporting layer, on the other hand, are sealingly joined to one another and, in a region of a respective one of the elevations, are formed with apertures communicating with one another, the surface layer being formed with openings communicating with the apertures.

In accordance with yet a further feature of the invention, the guiding device comprises a chamber arrangement forming domes due to the elevations of the trough base.

In accordance with yet an added feature of the invention, the surface layer is provided with nozzles, a respective one of the nozzles, on the one hand, forming one of the openings in the surface layer and, on the other hand, extending into one of the apertures formed in the supporting layer, which communicates with one of the openings.

In accordance with yet an additional feature of the invention, a respective one of the nozzles forms a shaped region of the surface layer.

In accordance with a concomitant aspect of the invention, there is provided a rotary printing machine having a guiding device for an areal printing material, the guiding device having an areal structure with a guide surface facing towards the printing material, the areal structure comprising a supporting layer, and including a surface layer forming the guide surface and covering the supporting layer.

In one configuration of the guiding device according to the invention, the supporting layer forms an underlayer for the surface layer forming the guide surface, and therefore does not have to rest smoothly on the surface layer over the entire area. In particular, the surface layer, in preferred improved constructions thereof, is shaped so that, in spite of a relatively small layer thickness, it has a dimensional stability which is sufficient for the requirements and, for example, fixing lugs molded on integrally or in one piece, whereas according to a further development, at least one support is provided which, together with the supporting layer, forms a subassembly.

The supporting layer can have deformations, for example, which are directed away from the surface layer covering the supporting layer and are formed as beads, so that, in particular, in the case of one development, wherein a support is provided that is joined to the sheet-like structure via a fastening on the supporting layer, at the bottom of the respective bead, the most varied types of connections or joinings of the supporting layer to a support are possible, without affecting the guide surface in any way thereby. Instead, the surface layer forming the guide surface bridges over the aforementioned beads and/or other irregularities or discontinuities which may be in the surface of the supporting layer facing the surface layer. In particular, therefore, the supporting layer can be screwed or welded to a support, at the base of appropriate beads on the supporting layer, to form a subassembly. However, welding the supporting layer to a support is possible even without the formation of beads in the supporting layer, even in the case of a given build-up of corresponding welds on that surface of the supporting layer which faces the surface layer, because a build-up which may have an effect upon the course of the surface layer can be ground off before the supporting layer is covered by the surface layer.

In a configuration according to the invention of the guiding device mentioned at the introduction hereto, in particular, no increased requirements are thus placed on the supporting layer, to the extent that it is the condition of a surface of the supporting layer which is covered by the surface layer.

The process of producing the aforementioned subassembly, therefore, does not require any special measures to protect surfaces of the parts belonging to the subassembly. Appropriate measures are required only during the completion of the guiding device, by covering the supporting layer by the surface layer, and the further handling of the completed guiding device. In the event of any damage which may occur to the guide surface in the process, such damage is restricted to replacing the surface layer so that costs arising from any reject, wastage or spoilage are noticeably lower than in the case of rejects during the production of conventional guiding devices.

In an advantageous improvement, the support is trough-like, it has feed and discharge openings and is otherwise closed by the supporting layer. If, in addition, a support of such a construction and the supporting layer are preferably sealingly joined to one another, a chamber results, through which a cooling liquid can be pumped. A guiding device constructed in such a way is therefore suitable for guiding a sheet printing material along path sections wherein heat is transferred onto the guiding device from a dryer.

In a preferred improvement, the aforementioned trough-like support has a trough base provided with elevations, and the elevations are joined to the supporting layer. Therefore, even with a relatively thin-walled construction of the supporting layer and of the support, the subassembly formed therefrom proves to be relatively stable dimensionally.

If, according to a preferred development of the support, the supporting layer and a respective one of the elevations of the support are sealingly joined to one another, the supporting layer, on the one hand, and a respective one of the elevations, on the other hand, in the area thereof, are provided with apertures which communicate with one another, and openings which communicate with the apertures are provided in the surface layer, then the aforementioned cooling liquid, as it flows through the chambers formed by the supporting layer and the support, is advantageously ducted straightforwardly so that, on the supporting layer and on the support, areas that are not in contact with the cooling liquid are formed and surround a respective one of the apertures, so that the support and the supporting layer, and therefore also the surface layer, permit a throughput through the apertures thereof of a fluid which is separate from the cooling liquid. In this case, the elevations in the trough base preferably constitute cup-like depressions which are indented in the trough base from the outside thereof.

The aforementioned fluid is then preferably gaseous and is formed of ambient air in an available or in a conditioned state and, for the purpose of the ducting thereof, provision is moreover preferably made of a chamber arrangement through which the fluid flows during operation and which, due to the elevations in the trough base, forms domes. In this case, conditioned ambient air is to be understood in particular to mean that this air is, for example, dried and/or warm and/or carries powder with it.

Depending upon the use of the guiding device, the flow through the chamber arrangement takes place in such a manner that blown air flows out of the openings provided in the surface layer, or in such a manner that these openings are connected to a vacuum source, or in such a manner that a number of these openings are connected to a vacuum source while blown air emerges from the remaining openings. For the last case, the chamber arrangement is subdivided into corresponding excess pressure chambers and vacuum chambers. A chamber arrangement in the form of a multiplicity of separate individual chambers is preferably also provided for the case wherein the openings provided in the surface layer are penetrated, in particular, in groups, by different volume flows, it then being the case that a respective group of the openings communicates with at least one of the individual chambers.

In a further improvement, the surface layer is provided with nozzles. A respective one of the nozzles, on the one hand, forms one of the openings in the surface layer and, on the other hand, extends into one of the apertures communicating with one of the openings. These nozzles are furthermore preferably formed by shaping the surface layer, so that they are joined to the surface layer integrally or in one piece. Overall, therefore, a guiding device provided for a sheet printing material is produced by a manufacturing process which can proceed to the greatest possible extent without taking special account of surface qualities. This is because particular care with a view to the protection of surfaces is required only when forming the openings provided in the surface layer and when fitting or applying the surface layer to the supporting layer.

Because of the one-piece connection or joint between the nozzle and the surface layer, it is moreover possible to achieve a continuous transition between the guide surface and a region of the surface layer that forms a respective one of the nozzles. In particular, in the region of the nozzles, no joints or steps result, which otherwise would be inevitable if separate nozzles were to be inserted into the guiding device.

Other features which are considered as characteristic for the invention are set forth in the appended claims.

Although the invention is illustrated and described herein as embodied in a guiding device for an areal printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Guiding devices for a sheet printing material are used both in web-fed rotary printing machines and in sheet-processing rotary printing machines and are preferably used in areas wherein the respective printing material is deflected as it passes through the respective machine. In this regard, sheet-processing rotary printing machines assume a special position, because a corresponding guiding device is provided therein also in order to guide the processed, i.e., printed and possibly varnished, sheets, on their path to a stacking station.

The following explanations are therefore based by way of example on a sheet-processing printing machine.

Figure 1:
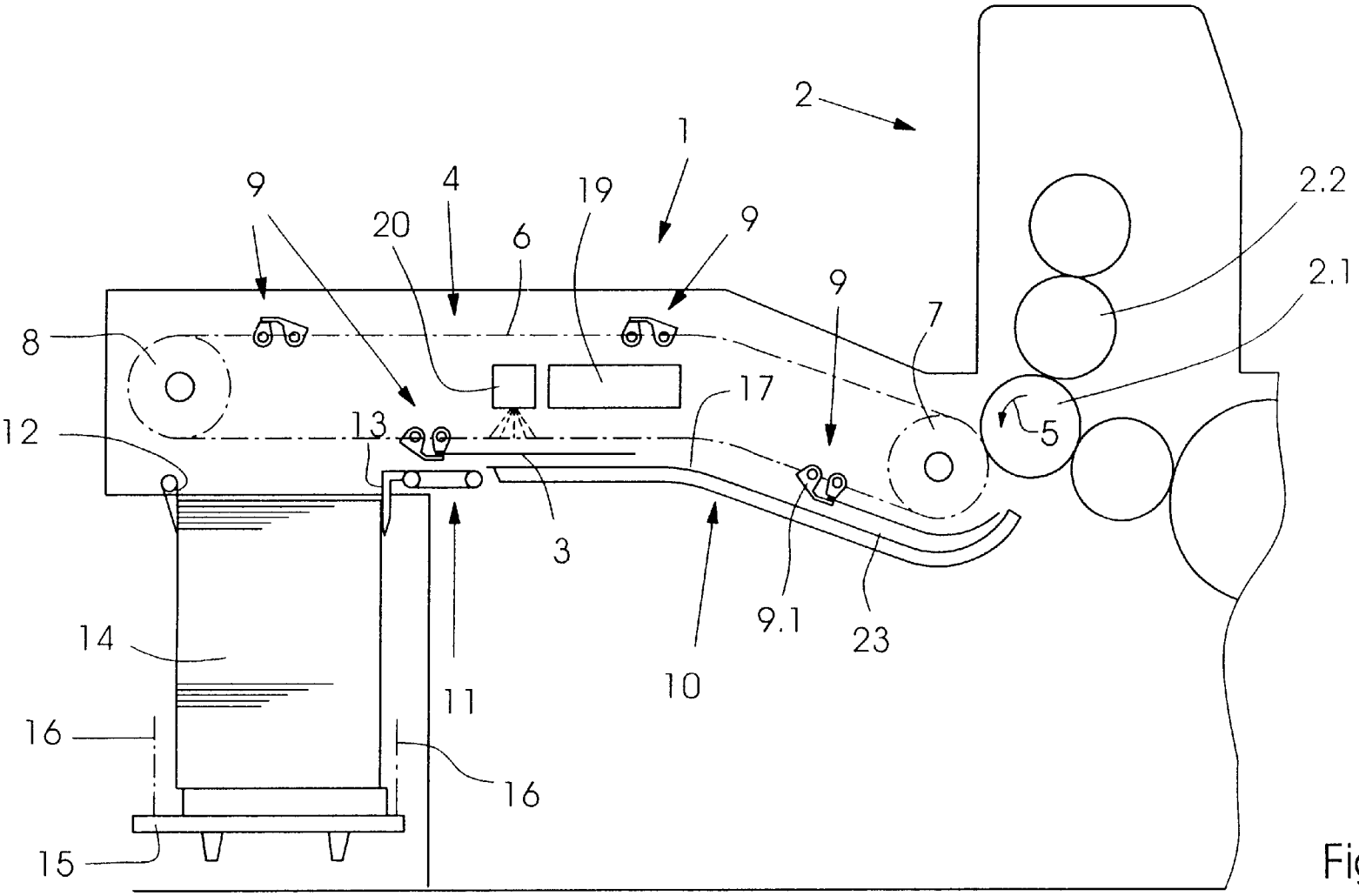
FIG. 1 is a fragmentary diagrammatic side elevational view of a sheet-processing rotary printing machine embodying the invention, and showing a delivery section thereof.

Referring now to the drawings and, first, particularly to FIG. 1 thereof, there is shown therein, accordingly, a section of a sheet-processing rotary printing machine, comprising a delivery 1 following a last processing station, which may be a printing unit or a post-treatment unit, such as a varnishing unit. In the exemplary embodiment at hand, the last processing station is a printing unit 2 operating with the offset process and having an impression cylinder 2.1. The latter guides an areal printing material in the form of a respective sheet 3, in a processing direction indicated by an arrow 5 representing the direction of rotation of the cylinder 2.1, through a printing nip formed between the impression cylinder 2.1 and a blanket cylinder 2.2 cooperating therewith, and then transfers the sheet 3 to a chain conveyor 4 while opening grippers which are arranged on the impression cylinder 2.1 and which are provided for gripping the sheet 3 at a gripper edge located at a leading end of the sheet 3. The chain conveyor 4 includes two conveyor chains 6, one of which, respectively, revolves along a respective side wall of the chain delivery 1 during operation. A respective conveyor chain 6 in each case wraps around one of two, respectively, synchronously driven drive sprockets 7, having axes of rotation which are mutually aligned and, in the exemplary embodiment at hand, is respectively guided over a deflection sprocket 8 which is located downline of the drive sprockets 7, as viewed in the processing direction. Extending between the two conveyor chains 6 and carried thereby are gripper systems 9 having grippers 9.1, which pass through gaps between the grippers arranged on the impression cylinder 2.1 and, in so doing, accept a respective sheet 3, gripping the aforementioned gripper edge at the leading end of the sheet 3, directly before the grippers arranged on the impression cylinder 2.1 open, transport the sheet over a guiding device 10, illustrated very diagrammatically in FIG. 1, to a sheet brake 11, and open thereat in order to transfer the sheet 3 to the sheet brake 11. The latter imparts to the sheet 3 a deposition speed which is reduced with respect to the processing speed and, after the deposition speed has been reached, in turn, releases the sheet 3, so that the respective, now decelerated or retarded sheet 3, finally encounters leading-edge stops 12 and, being aligned against the latter and against trailing-edge stops 13 located opposite thereto, together with preceding and/or following sheets 3 forms a sheet pile or stack 14, which is lowerable by a lifting mechanism to the same extent as the sheet pile or stack 14 grows. Of the lifting mechanism, only a platform 15 carrying the sheet pile or stack 14 and lifting chains 16, which carry the platform 15 and are represented in phantom, are reproduced in FIG. 1.

Along the paths thereof between the drive sprockets 7, on the one hand, and the deflection sprockets 8, on the other hand, the conveyor chains 6 are guided by chain guide rails, which consequently determine the chain paths of the chain strands. In the example at hand, the sheets 3 are transported by the lower chain strand, as shown in FIG. 1. That section of the chain path through which the lower chain strand passes is followed by a guide surface 17 which is formed on the guiding device 10 and faces towards that chain path section. Between the guide surface 17 and the respective sheet 3 guided thereover, a supporting air cushion is preferably formed during operation. For this purpose, the guiding device 10 is equipped with blown-air nozzles which open into the guide surface 17, the nozzles being discussed hereinafter in greater detail.

In order to prevent mutual adhesion between the printed sheets 3 in the sheet pile or stack 14, a dryer 19 and a powdering device 20 are provided on the path of the sheets 3 from the drive sprockets 7 to the sheet brake 11.

In order to avoid excessive heating of the guide surface 17 by the dryer 19, the guiding device 10 is integrated into a coolant circuit, which will likewise be discussed hereinafter in greater detail.

Figure 2:
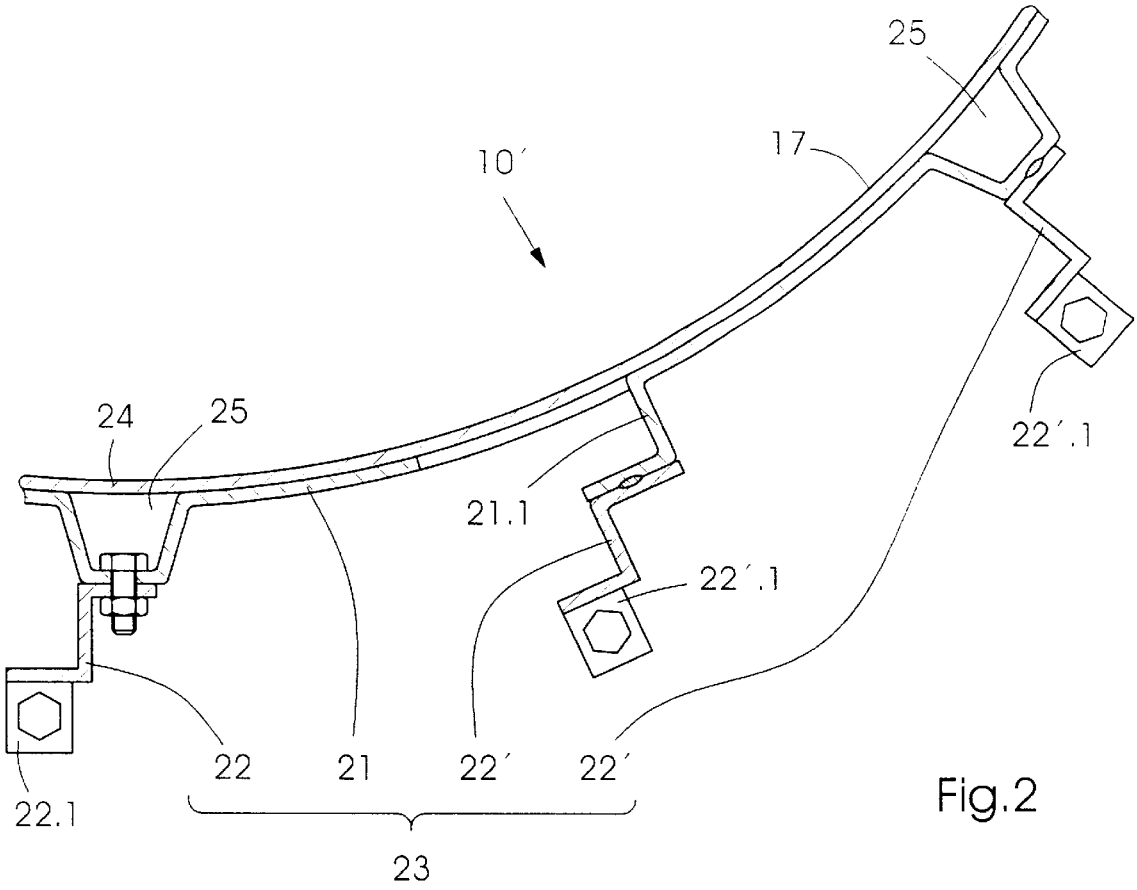
FIG. 2 is a fragmentary sectional view of a guiding device for areal printing material, constructed in accordance with the invention.

The principle upon which the construction of the guiding device according to the invention is based is apparent from FIG. 2, the principle being that a supporting layer 21 is covered by a surface layer 24, whereon the guide surface 17 is formed. Illustrated in FIG. 2 is a section 10' of the guiding device 10, that extends along the travel direction of the printing material 3. The section 10' includes a supporting layer 21 which, in accordance with a preferred construction, together with at least one support 22, 22' connected thereto, forms a subassembly 23. After constructing this subassembly 23, the supporting layer 21 is covered by the surface layer 24, whereon the guide surface 17 is formed.

It is believed to be readily apparent that, in every case, in the direction transverse to the travel direction of the printing material, the surface layer 24 extends at least over that extent,of the printing material disposed transversely to the travel direction. However, the transverse extent of the surface layer 24 and also the transverse extent of the supporting layer 21 expediently project beyond that of the printing material, and at the edges of the guiding device, which are therefore located outside the transverse extent of the printing material, a preferably detachable connection between the surface layer 24 and the supporting layer 21 is provided. Nevertheless, non-detachable connections between the surface layer 24 and the supporting layer 21 in the areas of the aforementioned edges thereof are likewise within the scope of the invention, an appropriate detachable or non-detachable connection preferably being made following the formation of the subassembly 23. An appropriate connection between the surface layer 24 and the supporting layer 21 is, in particular, provided for the purpose of making the surface layer 24 follow a course having a trend that is predefined by the supporting layer 21. In this connection, the term "trend"means that the surface layer 24, in particular, bridges over local depressions in the supporting layer 21.

In the exemplary embodiment of FIG. 2, local depressions in all the supporting layer 21 are present in the form of turned-up tongues 21.1 of the supporting layer 21, and in the form of beads 25, which can be cup-like or can extend over the supporting layer 21, transversely with respect to the travel direction of the printing material, and form areas wherein it is possible to connect the supporting layer 21 to a support 22 or 22' without having any effect upon the surface layer 24.

In a further improvement, a combination of cup-shaped and elongated beads is provided.

As examples of possible types of connections, a bolt or screw connection to the support 22, and a welded connection to the support 22' are illustrated in FIG. 2.

In exemplary embodiments reproduced in FIG. 2, the supports 22 and 22', respectively, serve for assembling the guiding device 10' in a rotary printing machine, such as is illustrated by way of example in FIG. 1. For this purpose, turned-up edges 22.1 and 22'.1, respectively, are provided on the supports 22 and 22', respectively, which, for example, with contact thereof with a respective side wall of the rotary printing machine, are fixed in the latter by screw connections.

In a non-illustrated construction, elongated beads extending transversely to the travel direction of the printing material are formed and, at the base thereof, fixing lugs molded on in one piece and corresponding to the turned-up edges 22.1 and 22'.1, respectively, are provided.

Figure 3:
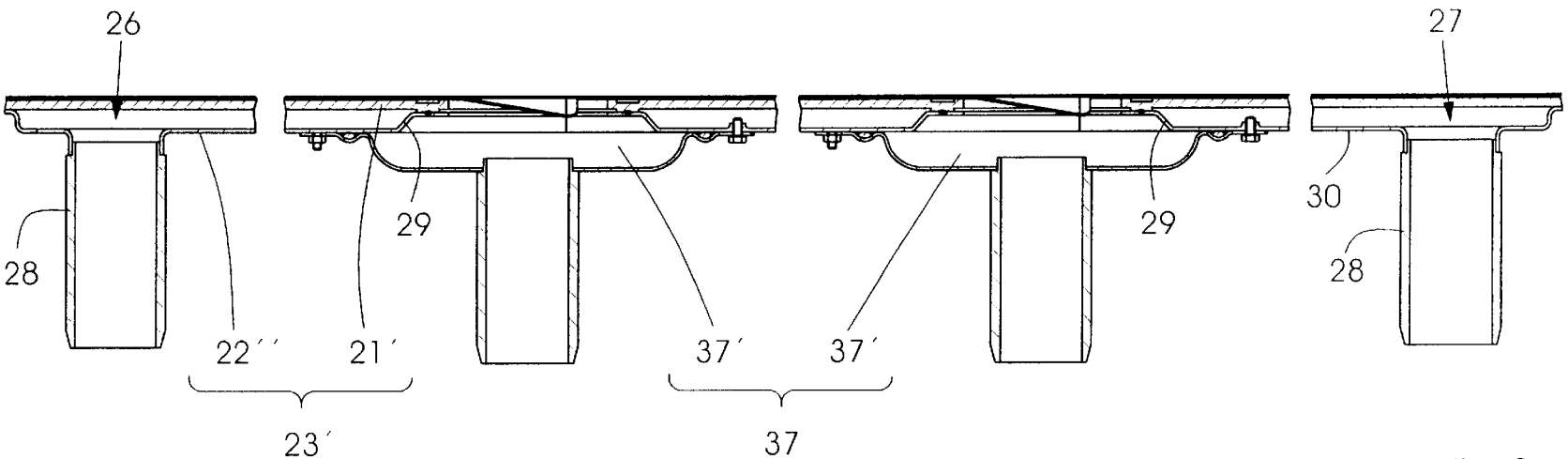
FIG. 3 is a fragmentary, partly broken-away sectional view of the guiding device according to the invention, which is usable as a floating guide for a printing material guided thereover and is traversible by a cooling liquid flowing therethrough.

Sections of the guiding device 10 illustrated only in very simplified diagrammatic form in FIG. 1 are reproduced in extended form, by way of example, in FIG. 3 in the form of a section along the travel direction of the printing material and in accordance with a preferred embodiment. In this case, a supporting layer 21' and a support 22" connected thereto form a subassembly 23' of a configuration which is special inasmuch as the support 22" is trough-like, has a feed opening 26 and a discharge opening 27 and is otherwise closed by the supporting layer 21'.

The supporting layer 21' and the support 22" are further preferably connected tightly sealed to one another, so that a chamber is formed, which can be integrated into a cooling-liquid circuit via connecting pieces 28 connected on one side to the feed opening 26 and on the other side to the discharge opening 27.

In addition, the trough-like support 22" has a trough base 30 provided with elevations 29. Between the elevations 29 and the supporting layer 21' there is a connection which, among others, contributes a given dimensional stability to the subassembly 23', even when the wall thicknesses of the supporting layer 21' and the carrier 22" are relatively small.

Figure 4:
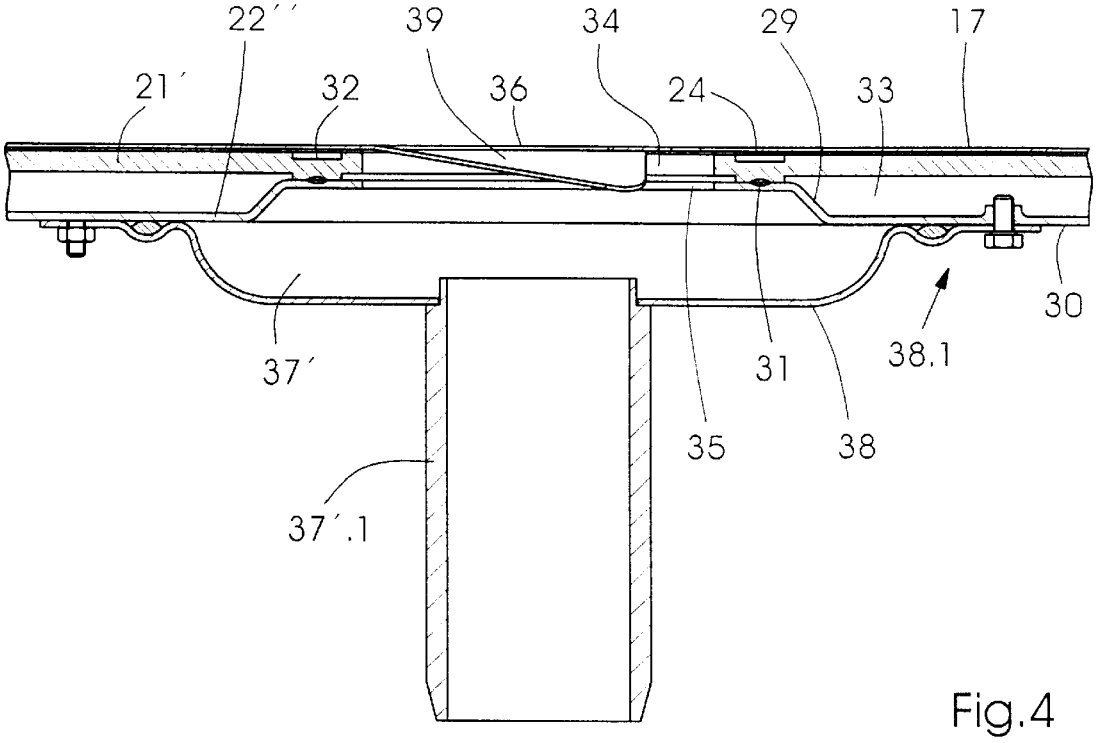
FIG. 4 is an enlarged fragmentary view of FIG. 3.

FIG. 4 is an enlarged view of one of the sections of the guiding device, which is disposed between end sections of the guiding device shown in FIG. 3, and offers a clearer view of special features thereof explained hereinbelow than may be seen in FIG. 3.

These special features include, among other things, the fact that the aforementioned connection between the elevations 29 and the supporting layer 21' is formed as a sealing connection. For this purpose, in this exemplary embodiment of FIG. 4, the elevations 29 projecting beyond the trough base 30 in the direction towards the supporting layer 21' are formed as cup-like depressions indented into the trough base 30 from outside thereof, and connected to the supporting layer 21' by an endless weld 31. As explained hereinbefore, a connection or joint of this type has no problematic effect with regard to the quality of the guide surface 17 formed on the surface layer 24, because the weld is preferably located in the base of a bead 32 formed in the supporting layer 21', the base of the bead 32 being directed away from the surface layer 24.

During a preferred manner of producing the weld 31 by a laser, the power thereof is set to a sufficiently high value that an entirely satisfactory joint or connection between the supporting layer 21' and the elevations 29 is achieved. In this regard, it does not matter from which side the laser is directed onto the parts to be joined or connected thereby, because, both options regarding the bead do not give rise to any impairment which could have a detrimental effect upon the guide surface 17 of the surface layer 24, which is completely unaffected by the welding operation.

The sealing joint or connection which has been mentioned hereinbefore and is otherwise provided between the supporting layer 21' and the trough-like support 22", i.e., joining or connecting the supporting layer 21' to a circumferential rim of the support 22", is preferably likewise produced by welding by a laser, but differing from as illustrated in FIG. 3, the supporting layer 21' is provided with a bead which follows the circumferential rim and is directed away from the surface layer 24 and has a base wherein a corresponding endless weld extends. If such a bead were to be dispensed with, a local build-up of material, which might be produced on the supporting layer 21' by the welding, would have to be removed, if it had a disruptive effect on the course of the surface layer 24.

If, as mentioned hereinbefore, a coolant chamber 33 integrated in a cooling-liquid circuit is formed by the supporting layer 21' and the trough-like support 22", and if the elevations 29 are sealingly joined to the supporting layer 21' by a respective one of the welds 31, then a respective area enclosed by one of the welds 31 forms, in relation to a cooling liquid flowing through the coolant chamber 33, an island which cannot be reached by the fluid and which is formed, as presented hereinbelow, for the case wherein a printing material is guided floatingly over the guide surface 17.

The islands are distributed over the guiding device 10 in a given, here not illustrated arrangement, and are, respectively, provided with an aperture 34 in the supporting layer 21', and an aperture 35 in the support 22" communicating with the aperture 34. Provided in the surface layer 24 are openings 36, a respective one of which communicating with one of the apertures 34 provided in the supporting layer 21' and therefore also with one of the respectively associated apertures 35 formed in the support 22". In addition, a chamber device 37 is provided which is constructed so that the elevations 29 of the trough base 30 form domes of the chamber device 37. As explained hereinbefore, the chamber device 37 preferably includes separate individual chambers 37', respectively, including some of the elevations 29. A configuration of this type is reproduced in FIG. 3, merely by way of example. Here, the elevations 29 belonging to one of the individual chambers 37', respectively, follow one another perpendicularly to the plane of the drawing. The construction of the guiding device is not restricted, however, to this arrangement of elevations 29 and individual chambers 37'.

In this exemplary embodiment, a respective individual chamber 37' is formed by a trough 38 which, at a trough rim 38.1 thereof, is joined to the trough-like support 22" by that side of the trough base 30 which faces away from the supporting layer 21'.

A respective individual chamber 37' is connectable via a connecting piece 37'.1 communicating therewith, to a blower or a vacuum generator, as required, so that with regard to the configuration of the guiding device described hereinbefore, a respective opening 36 in the surface layer 24 is traversible by ambient air in one or the other opposite direction during operation without any further measures.

In this regard, in principle, lower requirements are made as to the tightness of the joint or connection between the trough rim 38.1 and the support 22" than as to the respective joints or connections between the support 22' and the supporting layer 21'. In particular, it is sufficient to screw the trough base 38.1 to the trough base 30 of the support 22", with the interposition of a loop or O-ring seal, for example. For this purpose, as illustrated alternatively in FIG. 4, threaded bolts are welded onto the trough base 30 or threaded sockets are inserted into the trough base 30.

Figure 5:
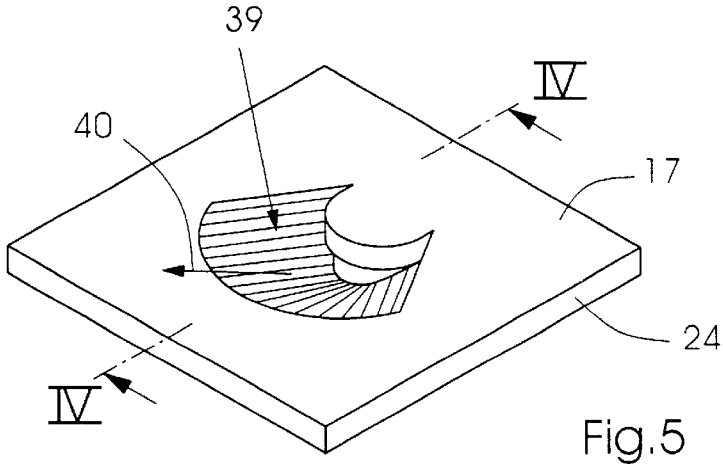
FIG. 5 is a reduced top and two-side perspective view of the guiding device of FIG. 4, rotated approximately 45° counterclockwise.

In particular, for the case wherein an individual chamber 37' is connected to a blower, an opening 36 through which air flows out of the individual chamber 37', respectively, is formed at a nozzle 39, with which the surface layer 24 is provided, and which extends into the apertures 34 and 35 assigned to the opening 36 and formed in the supporting layer 21' and the support 22", respectively. The nozzles 39, respectively, form a shaped area of the surface layer 24 and, as indicated in FIG. 5, are produced by stamping and embossing. The arrow 40 in FIG. 5 indicates somewhat the main flow direction wherein an air flow generated by the aforementioned blower emerges from the nozzle 39. In FIG. 4, the nozzle 39 is represented, in accordance with the course of the section line IV—IV in FIG. 5, and is oriented, in the travel direction of the sheets 3, in accordance with the longitudinal section illustrated in FIG. 4 through a section of the guiding device 10 illustrated in very simplified diagrammatic form in FIG. 1. However, this illustrates only one of the possible orientations of the nozzles 39. Beyond this, there is also no restriction to the nozzles of the form reproduced by way of example in FIGS. 4 and 5. Within the scope of the invention, also included, in particular, are nozzle arrangements and shapes which, for example, produce a swirling flow.

Particularly in the case of the configuration of the guiding device 10 which has been integrated into a coolant circuit, the surface layer 24 and the supporting layer 21' are formed of materials with good thermal characteristics, and the surface layer 24 is bonded to the supporting layer 21' by a heat-resistant adhesive with a good thermal conduction property or characteristic.

We claim:

1. A guiding device for an areal printing material, comprising:

a supporting layer formed with apertures; and a surface layer forming a guide surface facing the printing material and covering said supporting layer, said surface layer being formed with openings;

said surface layer being formed with nozzles, a respective one of said nozzles, on the one hand, forming one of said openings in said surface layer and, on the other hand, extending into one of said apertures formed in said supporting layer, said one of said apertures communicating with said one of said openings.

2. The guiding device according to claim 1, including at least one support which, together with said supporting layer, forms a subassembly.

3. The guiding device according to claim 2, wherein said support is trough-shaped and has feed and discharge openings, and is otherwise closed by said supporting layer.

4. The guiding device according to claim 3, wherein said support and said supporting layer are sealingly joined to one another.

5. The guiding device according to claim 3, wherein said support has a trough base formed with elevations, and said elevations are joined to said supporting layer.

6. The guiding device according to claim 5, wherein:

said support and a respective one of said elevations, on the one hand, and said supporting layer, on the other hand, are sealingly joined to one another; and said support, in a region of a respective one of said elevations, is formed with a aperture communicating with one of said apertures of said supporting layer formed in said region of said respective one of said elevations, said openings in said surface layer communicating with said apertures.

7. The guiding device according with claim 6, comprising a chamber arrangement forming domes due to said elevations of said trough base.

8. The guiding device according to claim 1, wherein a respective one of said nozzles forms a shaped region of said surface layer.

9. A rotary printing machine having a guiding device for an areal printing material, comprising:

a supporting layer formed with apertures; and a surface layer forming a guide surface facing the printing material and covering said supporting layer, said surface layer being formed with openings;

said surface layer being formed with nozzles, a respective one of said nozzles, on the one hand, forming one of said openings in said surface layer and, on the other hand, extending into one of said apertures formed in said supporting layer, said one of said apertures communicating with said one of said openings.

10. A guiding device for an areal printing material, comprising:

having, a supporting layer formed with apertures and a surface layer forming a guide surface facing the printing material and covering said supporting layer;

at least one support, together with said supporting layer, forming a subassembly, said support being trough-shaped, said support having feed and discharge openings, and being otherwise closed by said supporting layer, said support having a trough base formed with elevations, said elevations being joined to said supporting layer, said support and a respective one of said elevations, on the one hand, and said supporting layer, on the other hand, being sealingly joined to one another and, in a region of a respective one of said elevations, being formed with apertures communicating with one another, said surface layer being formed with openings communicating with said apertures, said elevations of said trough base forming a dome-shaped chamber arrangement.

* * * * *